US005907976A

United States Patent [19]

Santoro, Jr. et al.

[11] Patent Number: 5,907,976

[45] Date of Patent: Jun. 1, 1999

[54] APPARATUS FOR DETERMINING THE ABSOLUTE POSITION OF THROTTLE DYNAMIC BRAKE AND REVERSER HANDLES ON A LOCOMOTIVE CONTROL STAND

[75] Inventors: Ralph Santoro, Jr., New Kensington; Paul J. Kettle, Jr., Pittsburgh; Vincent Ferri, Pittsburgh; Craig A. Miller, Pittsburgh, all of Pa.

[73] Assignee: Westinghouse Air Brake Co., Wilmerding, Pa.

[21] Appl. No.: 08/879,454

[22] Filed: Jun. 20, 1997

Related U.S. Application Data

[63] Continuation of application No. 08/340,526, Nov. 16, 1994, abandoned.

[51] Int. Cl.[6] ..... G05G 1/00

[52] U.S. Cl. ..... 74/491; 74/523; 364/426.05; 318/640; 250/231.15; 250/231.18

[58] Field of Search ..... 74/491, 523, 98; 364/426.05; 318/640; 250/231.15, 231.18

[56] References Cited

U.S. PATENT DOCUMENTS

| | | | |
|---|---|---|---|
| 3,715,579 | 2/1973 | Eblovi . | |
| 3,794,834 | 2/1974 | Auer, Jr. et al. . | |
| 3,805,056 | 4/1974 | Birkin . | |
| 3,956,682 | 5/1976 | Van Dyck | 318/640 |
| 4,924,395 | 5/1990 | Evans et al. | 364/426.05 |
| 5,016,840 | 5/1991 | Bezos . | |
| 5,086,641 | 2/1992 | Roselli | 250/231.18 X |
| 5,406,077 | 4/1995 | Aoki et al. | 250/231.18 |
| 5,444,613 | 8/1995 | Tani et al. | 318/640 X |
| 5,519,299 | 5/1996 | Ferri et al. | 318/640 |

FOREIGN PATENT DOCUMENTS

| | | | |
|---|---|---|---|
| 60-257307 | 12/1985 | Japan | 250/231.15 |

*Primary Examiner*—Charles A. Marmor
*Assistant Examiner*—David Fenstemacher
*Attorney, Agent, or Firm*—James Ray & Associates

[57] ABSTRACT

An apparatus for determining and encoding the position of a control handle on a control stand of a locomotive or other railway transit vehicle utilizing a rotational, absolute encoder rigidly mounted adjacent to the axle to which the control handle is attached for pivotal motion, wherein a drive transfer means interconnecting the control handle and/or axle with encoder has a driving ratio that will permit full partial rotation of the control handle, which is typically less than 90 degrees, to rotate the encoder axle through a significantly greater rotational angle not exceeding 360 degrees, for the purpose of making fuller use of the sensitivity and resolution range of the encoder.

1 Claim, 1 Drawing Sheet

APPARATUS FOR DETERMINING THE ABSOLUTE POSITION OF THROTTLE DYNAMIC BRAKE AND REVERSER HANDLES ON A LOCOMOTIVE CONTROL STAND

This is a continuation of application Ser. No. 08/340,526, filed Nov. 16, 1994, now abandoned.

FIELD OF THE INVENTION

The present invention relates generally to a control stand for a locomotive or other railway transit vehicle, and more particularly to a new and improved apparatus for determining the position of a throttle, dynamic brake and/or reverser control handle on a locomotive control stand, using an optical encoder at or near its limit of sensitivity and resolution to provide a more positive determination of the handle's pivotal position.

CROSS REFERENCE TO RELATED APPLICATIONS

The invention taught in this patent application is closely related to the inventions taught in the following co-pending patent applications: Electronically Controlled Locomotive Throttle Controller Including Remote Multiple Unit Throttle Control Ser. No. 08/340,525; Method And Apparatus For Determining And Encoding The Position Of A Reverser Handle On A Locomotive Control Stand, now U.S. Pat. No. 5,519,299, issued May 21, 1996; Digital Output Control Device and Method For Operating, now U.S. Pat. No. 5,537,285, issued Jul. 16, 1996; Method And Apparatus For Feedback Of Trainline Status To The Central Processor Of A Locomotive Throttle Controller, Ser. No. 08/340,239; Apparatus For Interlocking Throttle, Dynamic Brake And Reverser Handles On A Control Stand Of A Railway Locomotive, now U.S. Pat. No. 5,492,511, issued Feb. 20, 1996; Method Of Performing Diagnostics On An Electronically Controlled Railway Locomotive Throttle Controller, Ser. No. 08/340,652; Method Of Operating A Locomotive Mounted Throttle Controller Between Two Modes Of Operation Including A Transition Between Such Two Modes, now U.S. Pat. No. 5,500,799, issued Mar. 19, 1996; An Apparatus For And A Method Of Generating An Analog Signal For Control Of Dynamic Braking, Ser. No. 08/340,742; An Apparatus For Feedback Of An Analog Signal Used To Monitor And/Or Control Dynamic Braking And Method Of Operating, now U.S. Pat. No. 5,537,014, issued Jul. 16, 1996; An Apparatus To Enable Controlling A Throttle Controller From A Remote Host, Ser. No. 08/340,213; and Apparatus For Interlocking Reverser Handle On A Control Stand Of A Railway Locomotive, Ser. No. 08/340,538. Each of the above-referenced patent applications are being filed concurrently herewith and are assigned to the assignee of this invention. Additionally, the teachings of each of these patent applications is incorporated herein by reference thereto.

BACKGROUND OF THE INVENTION

In railroad locomotive operations, the throttle, dynamic brake and reverser actions of the locomotive, locomotives or other drive units, are controlled by the operator or engineer in the cab of the lead unit by manipulating three handles extending from the control stand, one handle each for throttle, dynamic brake, and reverser. The throttle handle, of course, controls the development of the tractive effort of the locomotive; i,e, the diesel engines or other power units. The dynamic brake handle controls the development of a retarding force known a dynamic brake, for example the electric motors driving the locomotive wheels, to place them in either motor mode where they will drive the wheels, or in generator mode, where they will function as a retarding force. The reverser handle controls the forward and reverse rotation of the electric motors to selectively drive the train forward or rearward, and includes a neutral position. Pursuant to current practice, the control stand is designed to be a man-to-machine interface and ideally is strictly an electronic/electric device having no direct mechanical, hydraulic or pneumatic connections the devices controlled. Instead, encoding means are preferably provided within the control stand to read and interpret the positions of the three handles, and convey appropriate signals, indicative of such positions, to an associated microcomputer. The associated microcomputer is programmed to interpret the encoded signals regarding the positions of the throttle, dynamic brake and reverser handles, as positioned at the control stand, and then electronically issue corresponding commands to manipulate the devices intended within the locomotive or locomotives. When utilizing a microcomputer, the throttle, dynamic brake and reverser commands effected at the control stand, are dependent upon the given angular positions of the three control handles, which are normally sensed and monitored by rotary encoding devices, which are mechanically coupled to associated rotary axles to which the control handles are secured, utilizing cams to actuate microswitches or contacts to provide a signal to the microcomputer as noted above. Such mechanical devices leave a lot to be desired, in that they do not provide the exacting degree of handle position determination as desired, are prone to mechanical failure, are cumbersome, space consuming, and require frequent adjustment.

With regard to the throttle and dynamic brake controls in particular, there is a need for more accurate and absolute encoder determinations because these controls can be set over a rather wide range of setting. The reverser control, on the other hand, is positionable to only three positions, namely, a "neutral" position at the center, and "forward" and "reverse" positions at either end. Accordingly, with regard to the reverser control, there is no need for any costly and complicated encoder technique to determine an absolute and exacting control handle position or command, as all that is necessary to determine is in which of the three positions the handle is located, namely, "forward", "reverse" or "neutral". Nevertheless, the prior art mechanically linked encoding mechanisms leave much to be desired, particularly with regard to determining and encoding the positions of the throttle and dynamic brake control handles.

There has been considerable development effort in the recent past to improve the encoder technology, particularly with regard to obtaining a more absolute determination and reading of the control handle positions. U.S. Pat. No. 5,036,468, issued on Jul. 30, 1991 to the same assignee as this invention, for example, discloses a new encoder apparatus and technique which is electronic rather than mechanical, to encode the absolute position of a pair a brake handles, on a train brake controller, one handle for operating the locomotive brakes and the other for operating the brakes on cars of the train. In that patented process, encoder means, such as optical encoders, are employed to optically determine the positions of the two brake handles, and produce a binary signal representative of those positions. With regard to each brake handle, the binary signal is converted to an analog signal, and electronically compared to a stored signal representative of the initial brake release position, to ascertain the difference between the newly selected position and the initial brake release position. An enabling means permits passage of the difference between the two positions when the newly selected brake position is greater than the initial brake release position, with the enabling means converting the analog signal back to a binary signal which is conveyed to the brake control apparatus to signify the actual brake change necessary. While this patented system is a significant improvement over prior art mechanical encoding techniques, it is specifically designed for a train brake control stand, and not particularly adaptable to a throttle control stand, as its circuitry, with signal converters and summing circuits, is more complicated than desired for a throttle control stand.

While more simplified use of optical encoders have been suggested, specifically attaching a rotary optical encoder directly to the end of the rotatable axle, such a concept would not make full utilization of the encoder's capabilities. This is because most optical encoders have sensing capabilities throughout a full rotational movement thereof; i.e., through a full 360 degrees. On the other hand, the limited pivotal nature of the control handles on the control stand, permits only a partial rotation of the handle, or axle to which it is attached. Since such pivotal rotation is normally limited to pivotal angles of less than 90 degrees, the optical encoder would necessarily be limited to the same rotational movement; i.e., less than 90 degrees. Accordingly, less than one fourth of a encoder's rotational capacity would be utilized, so that the encoder's degree of sensitivity would also be reduced to a value of less than one fourth of its capability.

SUMMARY OF THE INVENTION

The present invention is predicated upon a new and improved technique and apparatus for electronically determining the absolute position of the throttle and/or dynamic brake control handle on a locomotive control stand using a rotary, optical encoder to provide a simple direct signal for the encoded position indication, and capable of making full, or at least fuller, use of the encoder's 360 degree sensitivity. If desired, the apparatus of this invention can even be used to determine the absolute position of the reverser control handle. This apparatus and technique is a significant improvement over prior art mechanical techniques, in that it provides a far more accurate indication of the control handle position, is much simpler than the complicated mechanical devices, and even more simple than other electronic techniques as used in different applications.

In essence, the apparatus of this invention is intended to be incorporated into a more or less conventional locomotive control stand, whereby the control handles extend through a face plate of the control stand, and are pivotal on an axle to effect the control desired. Normally, the control handles extend through elongated slots in the face plate, which limit the extent of pivotal movement. The inventive apparatus comprises one rotary optical encoder attached adjacent to each axle rotated by a control handle to be monitored for rotary movement, but not with a direct attachment. Rotary encoders are normally provided with a rotatable disk attached to a rotatable axle extending from the encoder which must be rotated for encoding the rotational position of the disk. The encoder is designed to transmit a signal indicative of the rotational position of the disk or disk axle. Pursuant to the inventive apparatus, a drive transfer means is included, such as a gear arrangement, interconnecting the control handle, or its axle, with the encoder's disk axle such that the maximum extent of the control handle's partial rotation can be converted to nearly a full 360 degree rotation of the rotary encoder. In this way, a greater percentage of the encoder's sensitivity can be utilized to effect a more absolute determination and encoded signal regarding the control handle's rotational position.

OBJECTS OF THE INVENTION

It is, therefore, one of the primary objects of the present invention to provide a new and improved apparatus for determining and encoding the position of a control handle on a control stand of a locomotive or other railway transit vehicle, which provided a more absolute and exacting determination and encoded signal regarding the position thereof.

Another object of the present invention to provide a new and improved apparatus for determining and encoding the position of a control handle on a control stand of a locomotive or other railway transit vehicle, which not only provided a more absolute and exacting determination and encoded signal, but is exceptionally simple and low in cost.

A further object of the present invention to provide a new and improved apparatus for determining and encoding the position of a control handle on a control stand of a locomotive or other railway transit vehicle, which relies on the use of a rotary optical encoder and makes optimum use of the encoder's sensitivity.

Still another object of the present invention to provide a new and improved apparatus for determining and encoding the position of a control handle on a control stand of a locomotive or other railway transit vehicle, which relies on the use of a rotary optical encoder and drive transfer means interconnecting the control handle and encoder to optimize the encoder's sensitivity.

These and other objects and advantages of this invention will be realized from a full understanding of the following detailed description particularly when read in conjunction with the attached drawings, as described below.

DESCRIPTION OF A PREFERRED EMBODIMENT OF THE INVENTION

Figure 1:
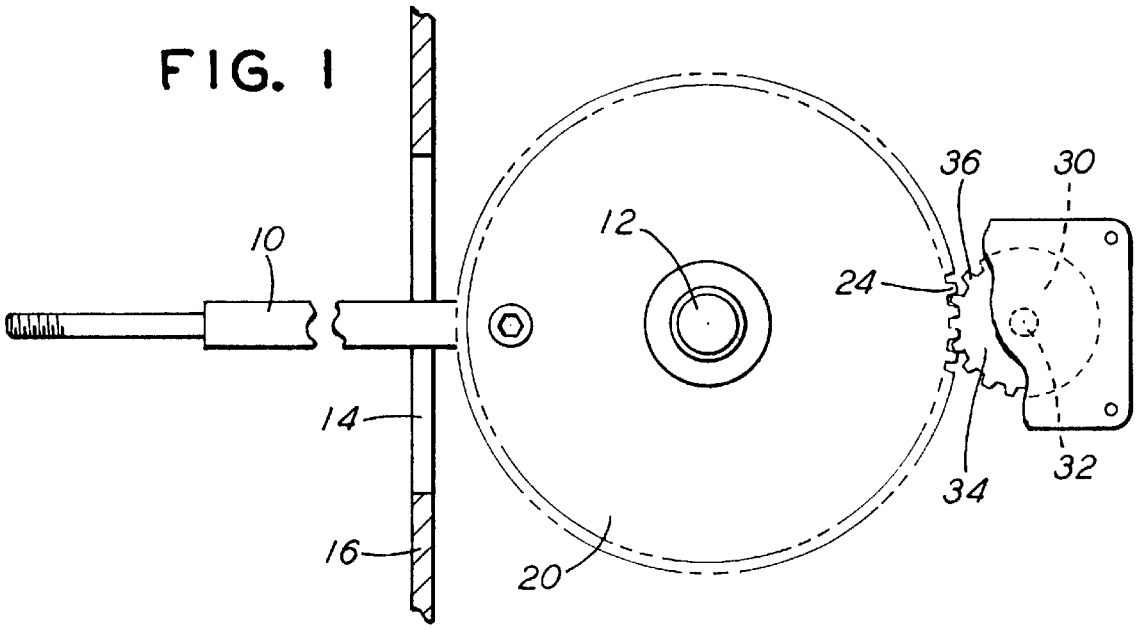
FIG. 1 is a side view of a presently preferred embodiment of this invention, with the axis of the control handle axle perpendicular to the plane of the paper.
Figure 2:
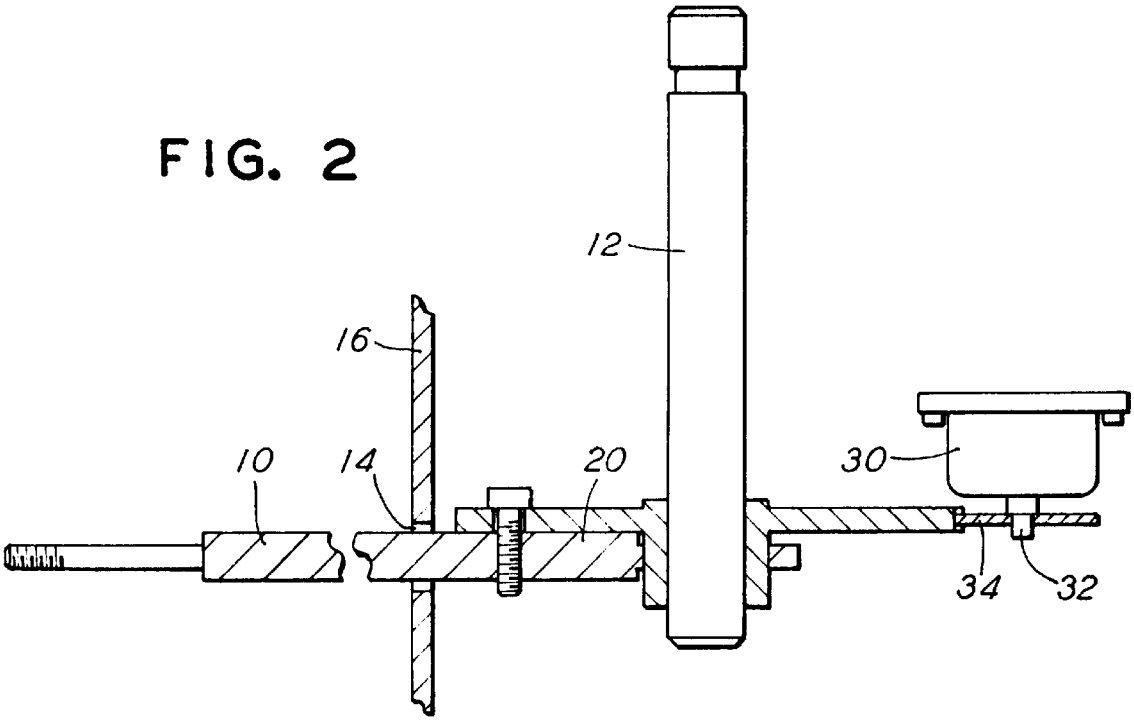
FIG. 2 is another side view of the apparatus shown in FIG. 1, with the axis of the control handle lying in the plane of the paper, further showing the control handle and first gear in cross-section.

Referring now to the two drawings, illustrated therein are two side views of the inventive apparatus of a presently preferred embodiment of this invention, wherein a control handle 10 is to be selectively positioned. The control handle 10 is representative of either a throttle control handle or a dynamic brake control handle, or ever a reverser control handle. As in any typical control stand, the control handle 10 is secured for rotational movement on an axle 12 within the control stand, and extends through an elongated slot 14, in face plate 16, of the control stand (not otherwise shown). A first circular gear 20, is perpendicularly secured to axle 12 for rotation with handle 10 on axle 12. As shown in this particular embodiment, first circular gear 20 is secured perpendicularly to axle 12, and control handle 10 is secured to gear 20. A set screw 22 is provided to interlock gear 20 and control handle 10, to assure that gear 20 will rotate with the pivotal rotation of handle 10. In this way, it makes no difference whether axle 12 actually rotates with control handle 10. As may be further apparent, the pivotal rotation of control handle 10 is limited by the ends of slot 14, to a pivotal rotation of approximately 80 degrees.

A rotary optical encoder 30, is rigidly attached to a structural element (not shown) such that the disk axle 32 on the encoder 30 is parallel to axle 12 and aligned adjacent to gear 20. A second circular gear 34 is rigidly attached to disk axle 32 and adapted such that gear teeth 36 thereon mesh with the gear teeth 24 on first circular gear 20. It should be apparent, therefore, that any pivotal movement of control handle 10 will cause a partial rotational movement of first circular gear 20, and a corresponding rotation of second circular gear 34 and disk axle 32. The crux of this invention resides in the drive transfer means, namely, first and second circular gears 20 and 34, and the relationship between them, which comprise the drive transfer means. Specifically, the diameters of the two gears 20 and 34 should be such that a full pivotal movement of control handle 10, as limited by slot 14, will cause disk axle 32 to rotate through an angle of no more than 360 degrees, but more than the angle through which first circular gear 20 is rotated. Accordingly, by rotating disk axle 32 through an angle greater that the angle of rotation of control handle 10, it should be apparent that a greater degree of sensitivity of the rotary optical encoder 30 can be utilized, for purposes of deriving a more exacting and absolute position indication of the handle 10. It should be further apparent, however, that disk axle 32 should not be rotatable through an angle of more than 360 degrees, for purposes of avoiding any over-lapping of positions at the extreme ends of the rotational movement, which would cause different positions to be identically encoded.

In the preferred embodiment employed, the drive transfer means; i.e., gears 20 and 34, are sized to provide a 4:1 rotational ratio. Since the control stand will normally permit control handle 10 to be pivoted through an angle of about 80 degrees, the 4:1 ratio will allow the disk axle 32, on encoder 30, to be rotated through an angle of about 320 degrees, and accordingly the sensitivity of the of the apparatus is quadrupled as compared to an encoder 30 directly connected to axle 12 in a 1:1 rotational relationship. While it is believed that practically any sort of a rotational encoder could be made to work, an absolute optical encoder is highly preferred. Specifically, the preferred encoder has been an absolute encoder as produced by Computer Optical Products, Inc., of 9305 Eton Avenue, Chatsworth, Calif. part number CP-350-008AN-WAB, which is a specially version, 8-bit absolute analog encoder.

In practice, the above described absolute optical encoder has a resolution of 360; i.e., having a capability of producing a signal each degree of rotation of the encoder disk, and produces a current signal of from 4 to 20 milliampere. The milliampere current signal is converted to a voltage signal for transmission to the microcomputer.

As should be apparent from the above detailed description, a number of modifications and other embodiments could be incorporated without departing from the spirit of the invention. For example, a variety of different types of rotational encoders could be utilized as suggested above. While the drive transfer means has been shown to be a pair of gears 20 and 32 aligned and positioned in a single plane, it is obvious that means other than gear could be utilized, such as a chain, for example, and that other gear arrangement could be utilized, and that the gears need no be disposed in a single plane. Obviously, gears intermeshing at an angle would work equally well. Therefore, while the detailed description above represents the preferred technique and apparatus as utilized in the presently preferred embodiment, and represents perhaps the most simple technique to achieved the desired results, it should be apparent that a great number of changes could be incorporated without departing from the spirit of the invention.

We claim:

1. An apparatus which determines and encodes the position of a throttle control handle on a control stand of a locomotive or other railway transit vehicle, comprising:

said throttle control handle secured to a first axle partially rotatable through a defined first angle of less than about 180 degrees, in response to pivotal movement of said throttle control handle;

a rotational encoder rigidly mounted adjacent to said first axle, said rotational encoder having a rotatable disk axle spaced from said first axle, said rotational encoder adapted to transmit a signal indicative of the rotational position of said disk axle through a rotation of about 360 degrees;

said signal comprising an electric current within the range of 4 to 20 milliamperes depending upon the rotational position of said disk axle, which signal is transmitted to a microcomputer for controlling a drive element within said locomotive;

drive transfer means interconnecting said first axle with said disk axle such that pivotal rotation of said throttle control handle will cause rotation of said disk axle, said drive means having a driving ratio such that full pivotal rotation of said throttle control handle through said defined first angle of less than about 180 degrees, will cause rotation of said disk axle through a second angle of rotation of about 360 degrees.

* * * * *